US006360970B1

(12) United States Patent
Fitzgerald

(10) Patent No.: US 6,360,970 B1
(45) Date of Patent: Mar. 26, 2002

(54) WATER DIFFUSER

(76) Inventor: Larry A. Fitzgerald, 16190 109th St. NW., South Haven, MN (US) 55382

( * ) Notice: Subject to any disclaimer, the term of this patent is extended or adjusted under 35 U.S.C. 154(b) by 0 days.

(21) Appl. No.: 09/562,377

(22) Filed: May 1, 2000

(51) Int. Cl.[7] ..... B05B 1/26
(52) U.S. Cl. ..... 239/499; 239/500; 239/467; 239/554; 239/504; 239/522
(58) Field of Search ..... 239/499, 500, 239/467, 470, 555, 554, 504, 522; 138/44, 39

(56) References Cited

U.S. PATENT DOCUMENTS

| | | | | |
|---|---|---|---|---|
| 1,515,766 A | | 11/1924 | Astren | |
| 1,663,998 A | * | 3/1928 | Schmidt | 138/44 |
| 1,877,046 A | | 9/1932 | Phillips | |
| 2,314,754 A | * | 3/1943 | Baird | 239/500 |
| 3,061,204 A | | 10/1962 | MacInnes et al. | |
| 4,241,805 A | * | 12/1980 | Chance, Jr. | 138/44 |
| 5,893,521 A | * | 4/1999 | Bertain | 239/500 |

FOREIGN PATENT DOCUMENTS

| | | |
|---|---|---|
| GB | 22234 | 11/1915 |
| RU | 1599108 | 10/1990 |

* cited by examiner

*Primary Examiner*—David A. Scherbel
*Assistant Examiner*—Dinh Q. Nguyen
(74) *Attorney, Agent, or Firm*—Hugh D. Jaeger

(57) ABSTRACT

A water diffuser for an automatic fire sprinkler system to be used when the sprinkler system is drained or tested. The water diffuser has a plurality of diffuser plates with decreasing diameter holes in their centers for dispersing water over a greater area, thereby reducing erosion and damage to the landscaping and/or grass.

1 Claim, 3 Drawing Sheets

WATER DIFFUSER

CROSS REFERENCES TO CO-PENDING APPLICATIONS

None.

BACKGROUND OF THE INVENTION

1. Field of the Invention

The present invention is for a water diffuser, and more particularly, pertains to a water diffuser for use when testing or draining automatic fire sprinkler systems.

2. Description of the Prior Art

Whenever an automatic fire sprinkler system is tested or drained, the water is usually discharged out of a pipe extending outwardly on the side of the building, causing a direct 2-inch flow of water, usually onto landscaping, such as a garden bed or grass. This 2-inch flow of water causes considerable damage to the garden bed or grass. It can even cause washout of the soil adjacent to the building wall.

The present invention overcomes the disadvantages of the prior art problems by providing a water diffuser for dispersing water over a greater area to thereby reduce damage to the landscaping.

SUMMARY OF THE INVENTION

The general purpose of the present invention is to provide a water diffuser for use in conjunction with the testing or draining of an automatic fire sprinkler system.

According to one embodiment of the present invention, there is provided a water diffuser with a threaded pipe, an arched top secured to the threaded pipe, a diffuser member secured to the top which is a half cylindrical member, a plurality of evenly spaced diffuser plates secured to the interior of the half cylindrical member, and a bottom or lowermost diffuser plate secured to the end of the half cylindrical member. Each of the diffuser plates from top to bottom has a hole of a decreasing diameter in its center. In operation, a stream of water will pass through the threaded pipe and hit the first diffuser plate with the largest hole, some of the water will disperse outwardly of the half cylindrical member and some of the water will pass through the largest hole to the second diffuser plate with a smaller hole, some of the water will then again disperse outwardly of the half cylindrical member and some of the water will pass through the hole in the second diffuser plate to the third diffuser plate with the next smaller hole. This action continues until finally water arrives at the last diffuser plate with the smallest hole. By way of example and for purposes of illustration only, not to be construed as limiting the present invention, there can be six diffuser plates with holes ranging from 2½ inches to 1 inch. The last diffuser plate does not require a hole but may optionally include a hole.

One significant aspect and feature of the present invention is a water diffuser that is compatible with automatic fire sprinkler system discharge pipes, which usually extend out the side of a building.

Another significant aspect and feature of the present invention is a water diffuser which diffuses water out over a larger area than the conventional 2-inch discharge pipe.

Having thus described embodiments and significant aspects and features of the present invention, it is the principal object of the present invention to provide a water diffuser for spreading the discharged water from a discharge pipe in an automatic fire sprinkler system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
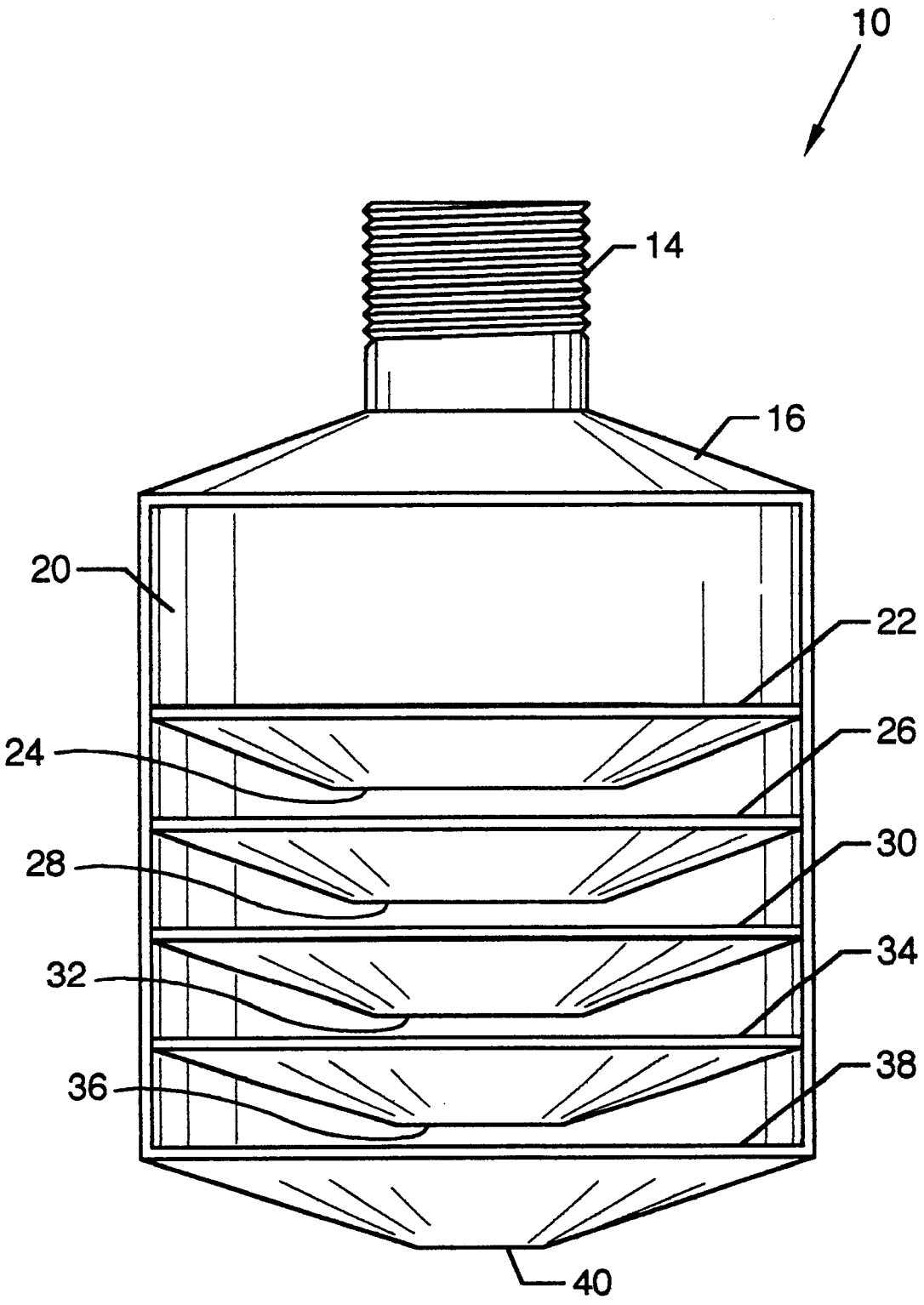
FIG. 1 illustrates a front view of a water diffuser, the present invention.

FIG. 1 illustrates a front view of a water diffuser 10, including a threaded pipe section 14 welded to an arched top 16 with a hole 18 (illustrated in FIG. 2) which provides for the passage of water. A half cylindrical member 20 of a finite length is welded to the bottom edge of the arched top 16. A plurality of diffuser plates 22, 26, 30 and 34 each with a downward arch and centrally located holes 24, 28, 32 and 36, respectively, of decreasing diameters are welded into the half cylindrical member 20. A last or lowermost diffuser plate 38 is welded to the bottom of the half cylindrical member 20. Diffuser plate 38 can be provided with an optional hole 40 for the purpose of drainage.

Figure 2:
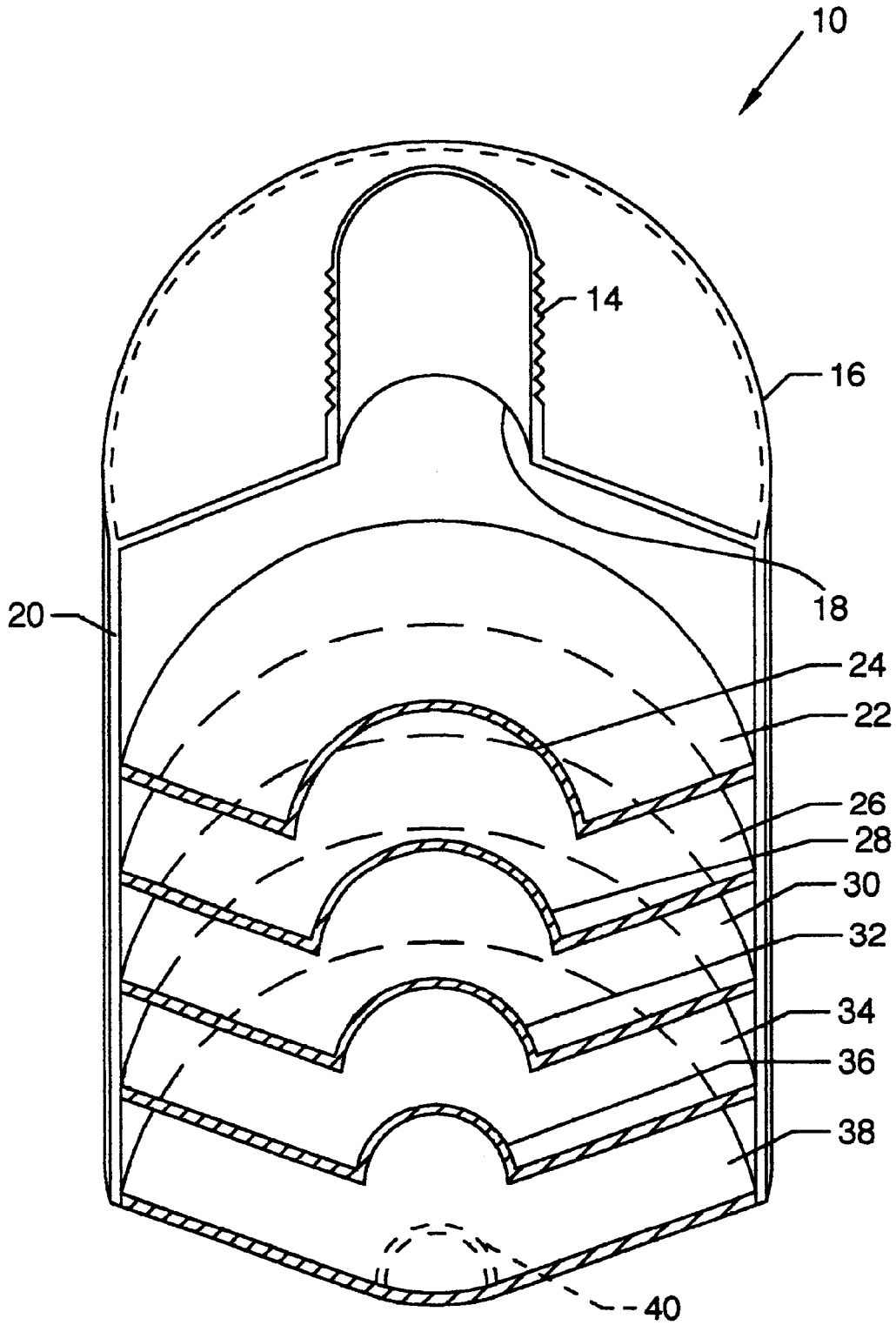
FIG. 2 illustrates a cross sectional view of the water diffuser.

FIG. 2 illustrates a cross sectional view of the water diffuser 10, where all numerals correspond to those elements previously described. Illustrated in detail are the centrally located holes 24, 28, 32 and 36 in diffuser plates 22, 26, 30 and 34. The optional hole 40 in diffuser plate 38 is illustrated in dashed lines in diffuser plate 38.

Figure 3:
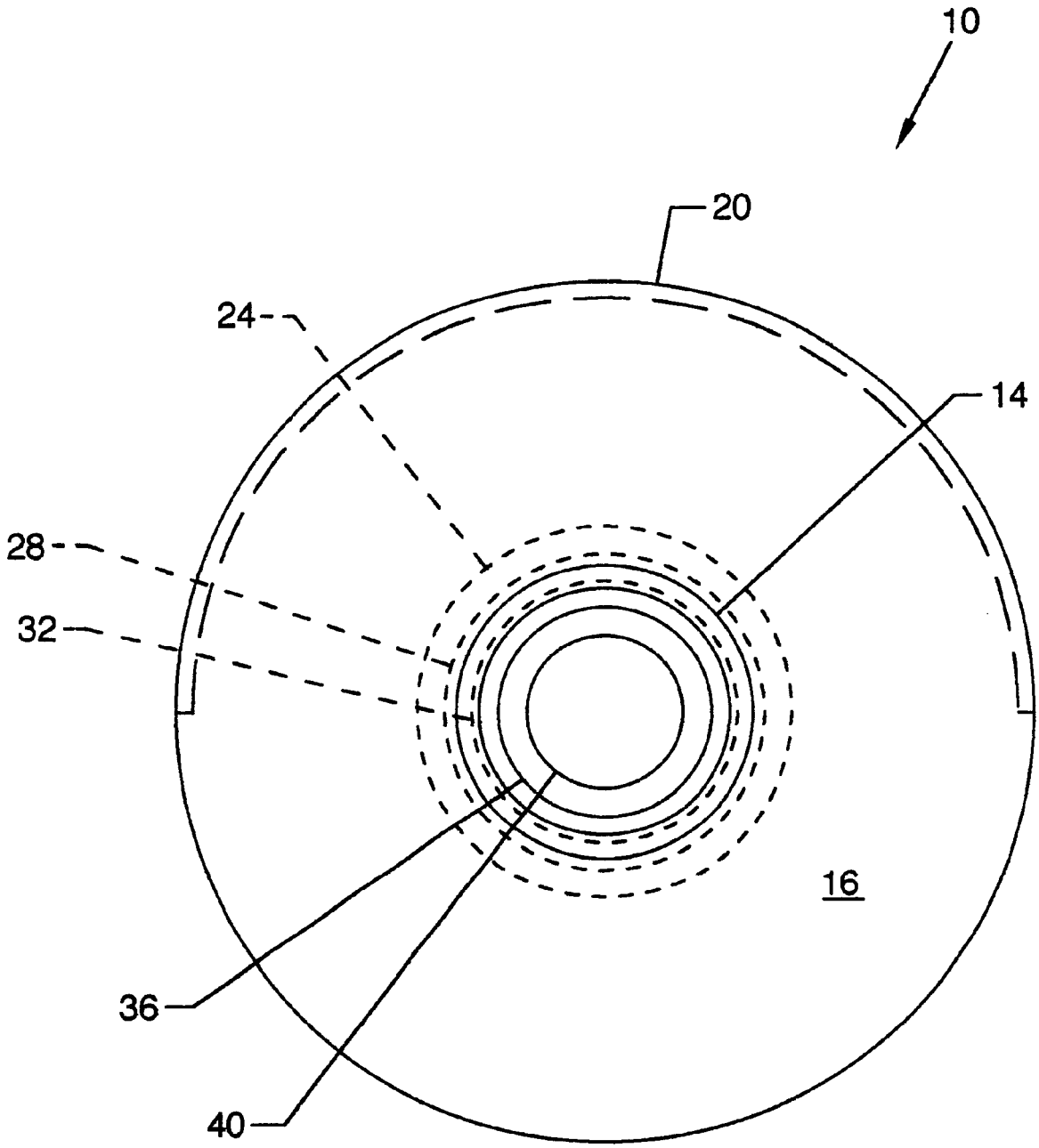
FIG. 3 illustrates a top view of the water diffuser.

FIG. 3 illustrates a top view of water diffuser 10, where all numerals correspond to those elements previously described. Illustrated in particular is the decreasing diameter of holes 24, 28, 32, 36 and 40.

Mode of Operation

The water diffuser 10 is connected to the discharge pipe of an automatic fire sprinkler system at threaded pipe section 14. When water is discharged from the automatic fire sprinkler system during testing or draining, a portion of the water is diffused outwardly at each diffuser plate 22, 26, 30, 34 and 38 because of the decreasing size of holes 24, 28, 32, 36 and 40. The water is thus dispersed over a greater area and the pressure of the water contacting the ground is reduced.

Various modifications can be made to the present invention without departing from the apparent scope hereof.

It is claimed:

1. A water diffuser for use in the testing or draining of an automatic fire sprinkler system; comprising:

a. a circular top member having an exterior surface, an interior surface, an outer periphery, and a centrally located hole extending therethrough from said exterior surface to said interior surface;

b. a threaded pipe section affixed to said circular top member in communication with said centrally located hole through said circular top member and projecting upwardly from said exterior surface of said circular top member;

c. a wall member comprising a cylindrical surface having an extent of approximately 180 degrees, said wall member having a proximal end, a distal end, an exterior side, and an interior side; said wall member extending downwardly from said circular top member and having its proximal end attached along said outer periphery of said circular top member;

d. a series of spaced apart circular diffuser plates, each circular diffuser plate having an outer periphery attached to said interior side of said wall member, and each circular diffuser plate having a centrally located hole extending therethrough, said centrally located holes through said circular diffuser plates being aligned with each other and with said centrally located hole in said circular top member, and said centrally located holes in said circular diffuser plates progressively decreasing in diameter from said proximal end of said wall member to said distal end of said wall member; and, e. a circular bottom plate attached to said distal end of said wall member.

* * * * *